US005149315A

United States Patent [19]

Muhs

[11] Patent Number: 5,149,315

[45] Date of Patent: Sep. 22, 1992

[54] METHOD OF MAKING LINED SQUARE BOTTOM BAG

[75] Inventor: Jeffrey D. Muhs, Ames, Iowa

[73] Assignee: American Packaging Corporation, Philadelphia, Pa.

[21] Appl. No.: 685,476

[22] Filed: Apr. 12, 1991

[51] Int. Cl.[5] ..... B31B 35/26; B31B 39/60

[52] U.S. Cl. ..... 493/189; 493/217; 493/253; 493/257; 493/261

[58] Field of Search ..... 493/189, 217, 253, 254, 493/255, 256, 257, 258, 259, 260, 261, 262, 263

[56] References Cited

U.S. PATENT DOCUMENTS

| | | | |
|---|---|---|---|
| 2,732,774 | 1/1956 | Honsel | 493/257 |
| 2,846,928 | 8/1958 | Kardon et al. | 493/208 |
| 3,266,387 | 8/1966 | Finke et al. | 493/257 |
| 3,547,010 | 12/1970 | Gennerich et al. | 493/256 |
| 3,645,815 | 2/1972 | Bedore | 493/261 |
| 3,896,709 | 7/1975 | Brinkmeier | 493/201 |
| 3,967,544 | 7/1976 | Brock et al. | 493/936 |
| 4,490,131 | 12/1984 | Coleman et al. | 493/217 |
| 4,636,189 | 1/1987 | Chen | 493/217 |
| 4,976,674 | 12/1990 | Yannuzzi et al. | 493/253 |

*Primary Examiner*—William E. Terrell
*Attorney, Agent, or Firm*—Frank A. Follmer

[57] ABSTRACT

A bag construction comprising an outer bag and an inner bag contained therewithin and a method of making the same. The bag has an independent unitary construction. The bag construction is made from a tube length having inner and outer portions, by cross sealing the inner portion and folding the outer portion into a rectangularly shaped bottom.

10 Claims, 7 Drawing Sheets

METHOD OF MAKING LINED SQUARE BOTTOM BAG

BACKGROUND OF THE INVENTION

1. Field of the Invention

This invention relates generally to bags and methods of making the same and, more particularly, to bags of the leakproof type having an automatic or self opening bottom construction.

2. Description of the Prior Art

Bags of the indicated type are disclosed in U.S. Pat. Nos. 2,496,796, 3,017,069, 3,342,402, 4,490,131, and 4,976,674. As disclosed in these patents, bags of this type generally comprise an outer sheet of paper and an inner liner of an impervious heat sealable material such as a plastic (synthetic resin). The bag is made of a tube and the bottom end of the bag is formed by making a diamond fold comprising a triangular fold portion and a partly rectangular tab fold portion. After the triangular fold portion and the tab fold portion are sealed, the bottom of the bag is completed by folding over the tab fold portion onto a previously folded over triangular fold portion. The tab fold portion is caused to adhere to the bottom of the bag by applying suitable adhesive between the contiquous faces of the tab fold portion and the triangular fold portion of the bag bottom structure. During this bottom forming procedure, the bag and the liner are in contiquous overlapping relation so as to form a single bottom structure having a two-ply configuration.

While the prior art bags can be effectively sealed so that the bag can contain many materials without any seepage through the bag bottom, the achievement of a good bottom seal can be attained only by the use of special sealing techniques.

SUMMARY OF THE INVENTION

It is the general object of the present invention to provide a bag construction which comprises an outer bag and an inner bag contained within the outer bag and formed as an independent unit from said outer bag.

A further object of the invention is to provide a bag comprising an outer bag and an inner bag and a method of making the same whereby the bottom of the bag will be effectively sealed against leakage so that the contents of said bag will be maintained in good condition without loss or deterioration by reason of sifting or breathing through breaks or openings in the bottom seal.

In accordance with another object of the present invention, there is provided a construction whereby the leakproof inner bag unit is adhered to the outer bag in a manner such that the inner bag can be removed easily from the outer bag for disposal purposes.

DETAILED DESCRIPTION OF THE PREFERRED EMBODIMENT

The method of making the bag in accordance with the invention will be performed in a manner and on equipment similar to that described in the above-listed patents, the essential difference being that the bag construction in accordance with the invention comprises a leakproof inner bag within an outer bag, said inner bag having an independent unitary construction.

Figure 15:
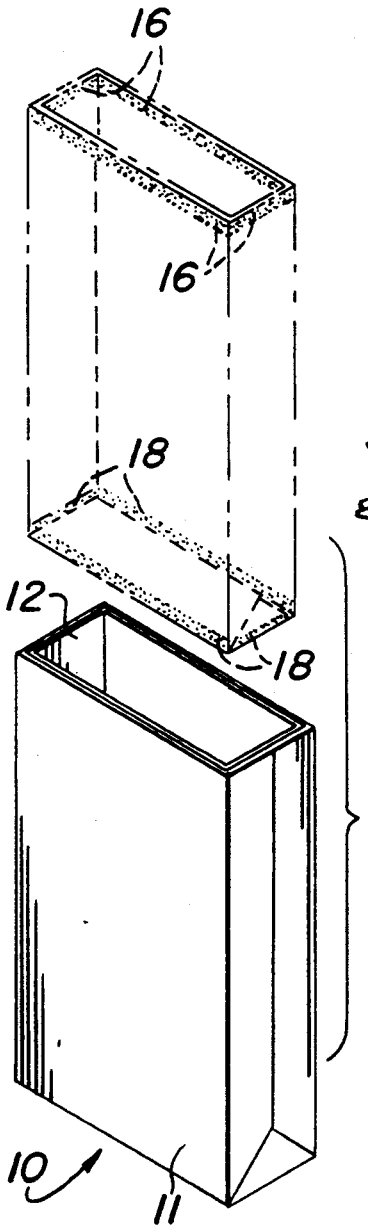
FIG. 15 is a perspective view showing the bag construction in accordance with the invention in an open condition.

The bag in accordance with the invention is indicated generally at 10, and is shown in an open condition in FIG. 15. The bag 10 comprises an outer bag 11 made of a sheet of paper, or other suitable material of requisite strength, and an inner bag 12 preferably made of a sheet of material impervious to the passage of air, vapor or moisture, but which is sufficiently fusable upon the application of heat to cause the abutting faces thereof to adhere to each other to provide a seal. Thus, inner bag 12 may be made of a heat sealable plastic (synthetic resin). Alternately, the inner bag 12 may be made of a paper with a heat sealable adhesive coating.

As is shown in the Drawings, the inner bag 12 is an independent unit from the outer bag 11. Also, the inner bag 12 has its bottom end formed to be independent of and to be located adjacent to the bottom of the outer bag 11. Further, as will be described more fully hereafter, means are provided for securing the inner bag 12 to the outer bag 11 in an overlapping relationship, said means including adhesive applied in a manner whereby the inner bag 12 can be easily separated from the outer bag 11 for disposal purposes.

Figure 1:
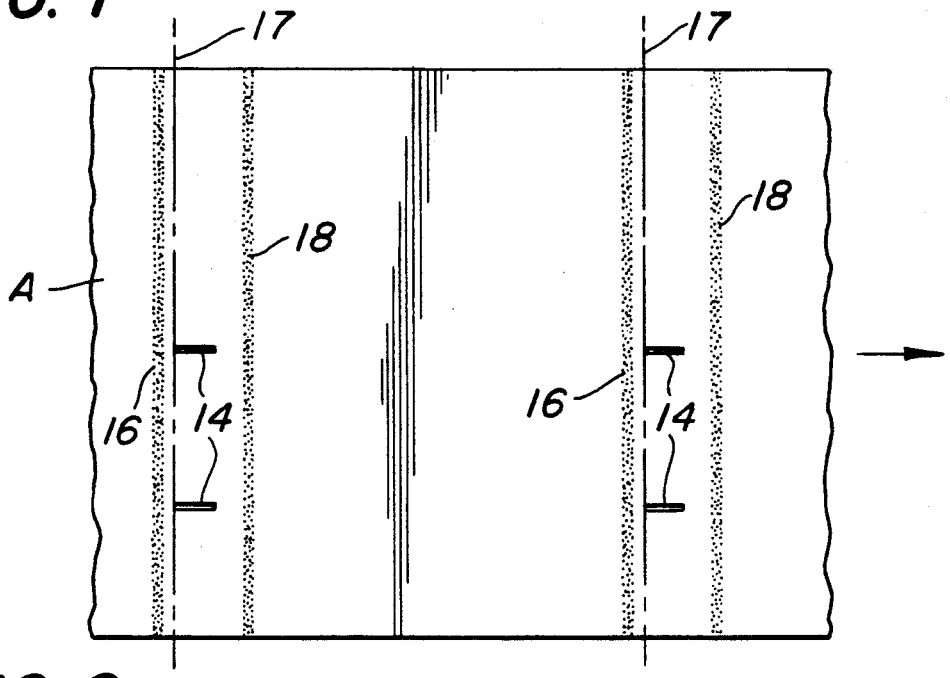
FIGS. 1, 2 and 3 are views illustrating successive steps in the method of forming a tube from which the bag construction in accordance with the invention is made.
Figure 2:
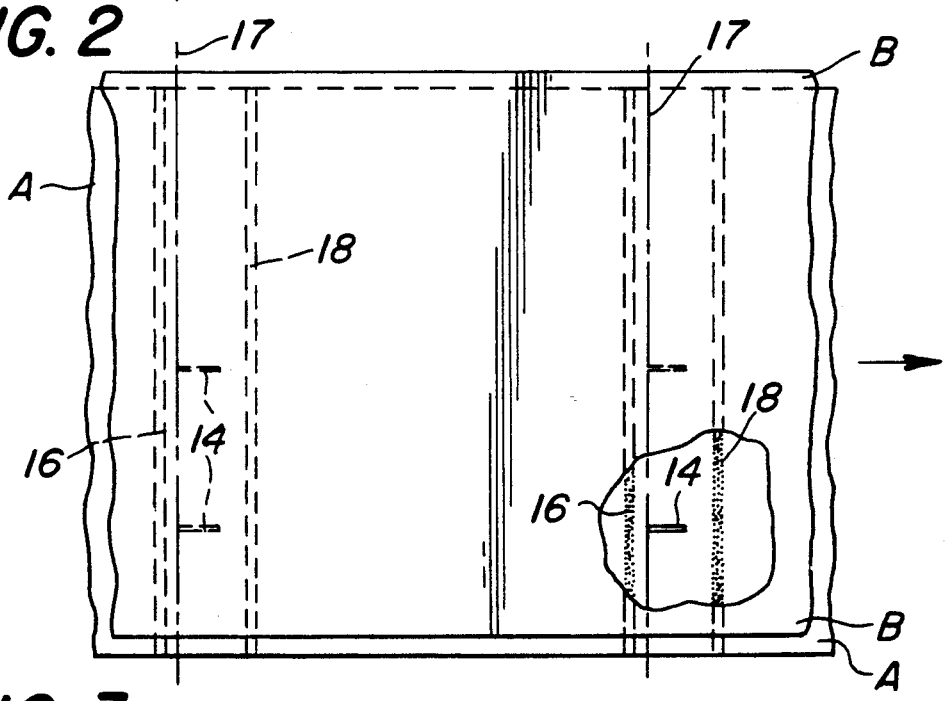
Figure 3:
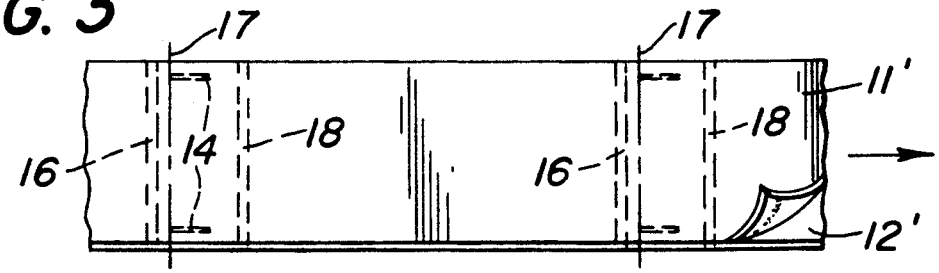
Figure 4:
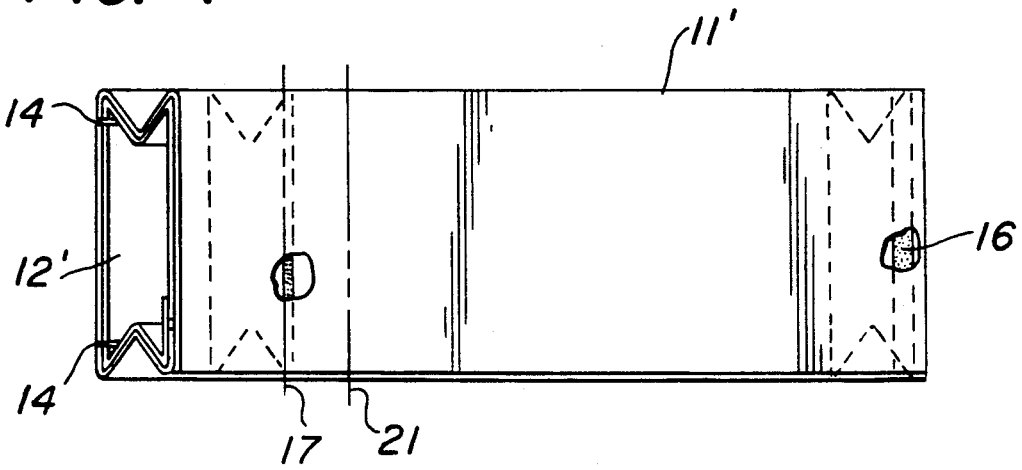
FIG. 4 is a view of a tube length from which the bag construction in accordance with the invention is made.

In the method of making the bag in accordance with the invention an initial step is to form a tube such as that shown in FIG. 3 having an outer tube 11' of paper and an inner tube 12' of an impervious, heat sealable plastic (synthetic resin) whereby the bag may be sealed against outside air and moisture by the heat sealing of the inner tube 12' in a manner in accordance with the invention to be described hereafter. The tube forming may be performed on available automatic bag making machines wherein a web A of the material for forming the outer tube 11' and a web B of the material for forming the inner tube 12' are fed from rolls in overlapping relationship and then folded together and cut into a tube length of the bellows-fold type, as shown in FIG. 4. As web A of material forming the outer tube 11' is fed to the tube forming machine pairs of slits 14 are formed therein, such slits 14 defining the tab portion that is part of the rectangular portion of the bottom of the outer bag 11 as will be described hereafter, and adhesive bars 16 and 18 are applied thereto as shown in FIG. 1. The adhesive bars 16 and 18 serve as adhesive means for attaching the inner bag 12 to the outer bag 11. Adhesive bars 16 and 18 are constructed and arranged so as to hold the plastic material forming the inner bag 12 in its intended place during the operations for forming the bag bottom and so as to enable the filling of the product without delamination during the use of the bag 10. Further, the adhesive bars 16 and 18 are constructed and arranged such that the inner bag 12 and the outer bag 11 can be easily separated for disposal thereof. Each adhesive bar 16 is located just adjacent the line 17 where the tube will be cut off to form the top end of the bag 10 in the final construction. Each adhesive bar 18 is located adjacent the fold line 19 where the tube is folded during the formation of the bag bottom, which fold line 19 also determines the lower end of the bag 10. As is conventional, the tube length is passed by a score cylinder 20 (FIG. 9) which creases it along fold line 19 and a second fold line 21 as the tube length is fed to the bottom forming operation as will be described hereafter, which creasing determines the lines of fold during the bottom forming of the outer bag 11. The laminated or overlapped condition of the web A forming the inner bag 12 and the web B forming the outer bag 11 is shown in FIG. 2, which is the condition of the webs A, B as they are fed to the tube forming machine in the direction of the arrows in FIGS. 1 and 2.

At the tube forming machine, the tube is formed by using a heater at the former to create a heat seal 22 at the longitudinally extending seam of the inner tube 12'. This heat seal is produced on the inner tube 12' only whereby the heat sealable material forming the inner tube 12' will not stick to the paper forming the outer tube 11' but will only stick to itself. The outer tube 11' is also secured along a longitudinally extending seam by means of an adhesive 23 applied between overlapping edge portions thereof as is conventional in the tube forming machines in use today. The condition of the bag structure after it has passed through the tube former is shown in FIG. 3, it being noted that the tube is in a continuous uncut form and it has been formed from a flat web as shown in FIG. 2 into a tube having gusseted sides. At the tube former, draw rollers pull the webs A and B through the former creating a tubular configuration which is then fed to a cutter where it is cut off into tube lengths along lines 17 to provide a tube structure as shown in FIG. 4, for example.

Figures 7, 8:
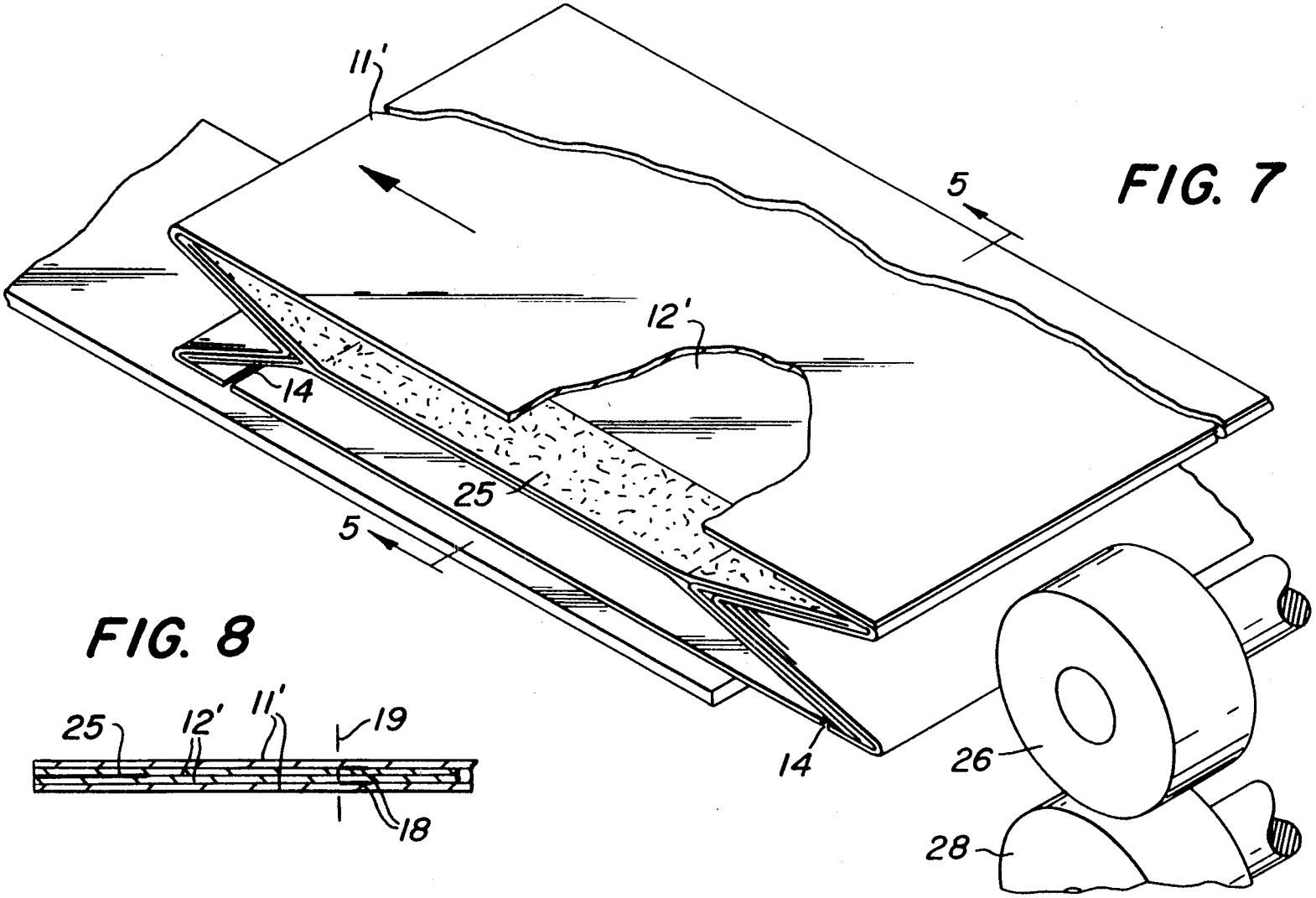
FIG. 7 is a perspective view illustrating the step in accordance with the method of the invention whereby a cross seal is formed to close the bottom end of the inner bag of the bag construction in accordance with the invention.
FIG. 8 is a sectional view of the bottom edge of the tube length as it is fed between pressure rollers.

The next step in the method in accordance with the invention is to advance each cut off tube length to a cross sealing area whereat a pressure and heat seal will be applied across the edge of the tube length that is to be located at the bottom end of the bag to form a cross seal 25 on the inner tube 12'. This step is illustrated in FIG. 7 which shows the tube length after the cross seal 25 has been formed, with the end being opened to provide a clearer view of the construction. FIG. 8 shows the bottom and as it is passed between a pair of pressure rollers 26 and 28. As shown in FIGS. 7 and 8, the cross seal 25 is located at the bottom end of the inner tube 12' and has a substantial width, which will vary depending on the size of the bag. The cross sealing step is achieved by feeding the tube length sideways in the direction of the arrow as shown in FIG. 7. As the tube lengths are fed along a conveyor toward the pair of pressure rollers 26 and 28, heat is applied to the bottom edge thereof to cause the heat sealable material of the inner tube 12' to soften and begin to melt and stick to itself. In the final stage of the cross sealing step, the tube length is fed between pressure rollers 26 and 28 which press the contiguous portions of the inner tube 12 together to form the cross seal 25. As shown in FIG. 7, cross seal 25 closes all contiguous portions at the bottom end of inner tube 12', including the center area and the two gussets at the outer ends of the center area. This provides a very effective seal across the bottom end of the inner tube 12' which will be formed into the inner bag 12 as will be described hereafter.

At the conclusion of the cross sealing step, it will be apparent that the inner tube 12' is now effectively sealed by means of two seals, namely, the longitudinally extending seam seal 22, which is formed during the tube formation at the tube former, and the cross seal 25 which extends transversely to seam seal 22 across the bottom end of the inner tube 12'. It is noted that both the seam seal 22 and the cross seal 25 are formed simply and effectively by conventional and reliable sealing means.

Figure 5:
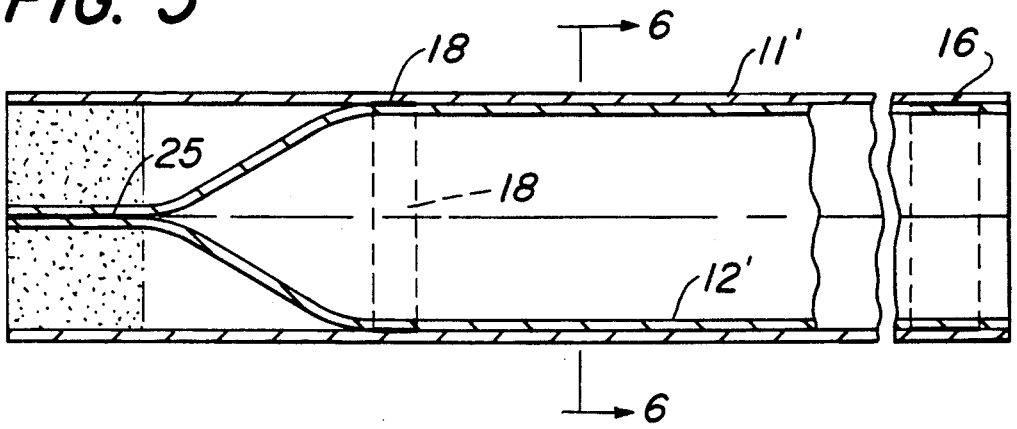
FIG. 5 is a section taken generally on line 5—5 of FIG. 7.
Figure 6:
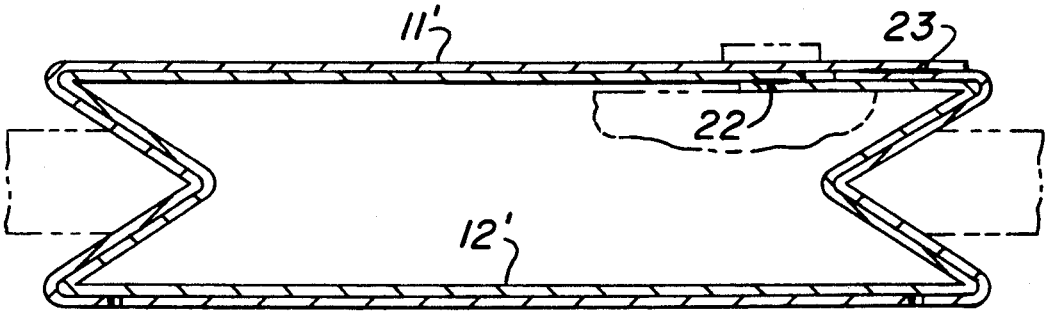
FIG. 6 is a section taken generally on line 6—6 of FIG. 5.

At this stage in the bag making method in accordance with the invention the inner tube 12' is sealed at its bottom end by cross seal 25 and is secure to the inner wall of the outer tube 11' at two bands of adhesive that extend completely around the tubular structure and are provided by the adhesive bars 16 and 18. The band provided by adhesive bar 18 is located to be adjacent the fold line 19, which will be applied later at the location shown by dashed lines in FIGS. 1, 2 and 4 and which defines the bottom of the completed bag 10. The portions of the outer tube 11' and the inner tube 12' outwardly of this location of the adhesive bar 18 are those portions of the tube length which will be formed into the bottom of the outer bag 11 and the bottom of the inner bag 12 in the manner to be described hereafter. As is illustrated in FIGS. 5 and 7, the bottom forming portion of inner tube 12' is not attached in any way to the bottom forming portion of the outer tube 11' whereby the bottoms of the outer bag 11 and the inner bag 12 can be formed to be independent of one another.

Figure 9:
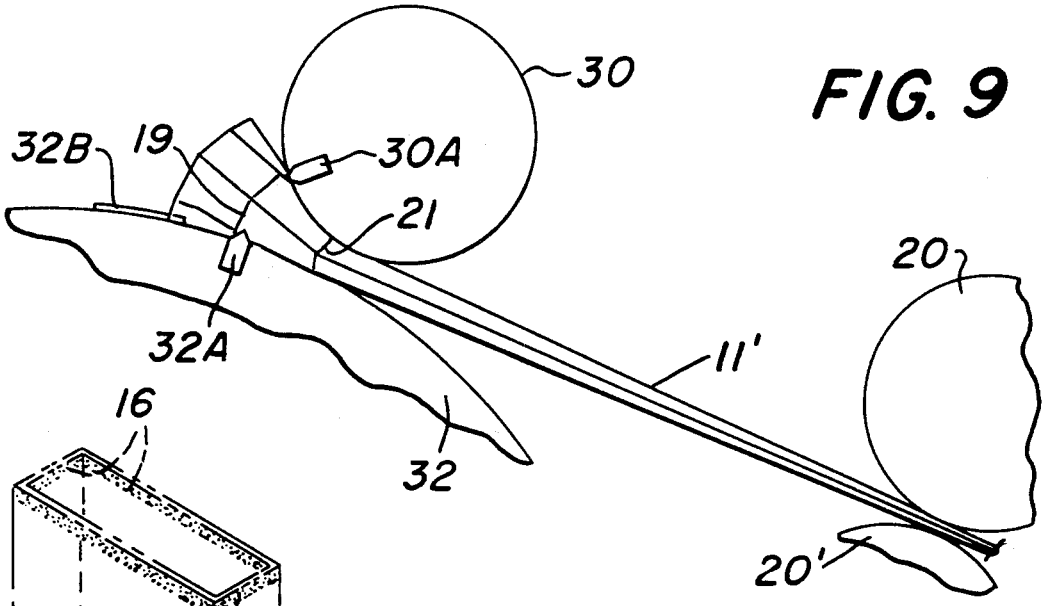
FIGS. 9 and 10 are views illustrating successive steps in the method of forming the bottom of the bag construction in accordance with the invention.
Figure 10:
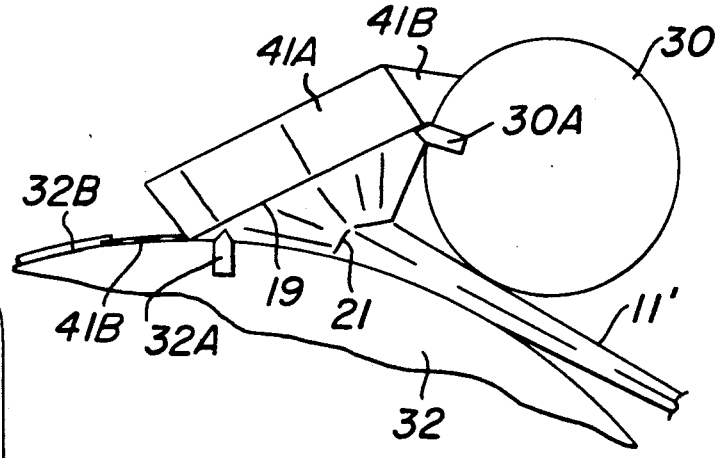

The next step in the method in accordance with the invention is to advance the tube length lengthwise to the bottom forming area where the scoring to form fold lines 19 and 21 and the bag bottom opening will be performed. Thus, as shown in FIG. 9, the tube length is passed between a score cylinder 20 and a cooperating cylinder 20' as it passes to the opening cylinder 30 and drum 32 which cooperates therewith for performing the opening procedure. As is conventional, score cylinder 20 carries blades which, as the cylinder 20 rotates, contact the tube length to crease it transversely to provide fold lines 19 and 21 for the subsequent folding procedure which will occur during the bottom forming step.

The next step in the method is to form the bottom of the bag construction, the initial stages of this step being illustrated in FIGS. 9, 10, 11 and 11A which show the part of the bottom forming step wherein the bottom of the outer tube 11' is opened in preparation for folding down the flaps thereof that are located beyond the fold line 19. As discussed above, in accordance with the invention, the bottom of the inner bag 12 will be formed to be an independent structure from the bottom of the outer bag 11.

Figure 11A:
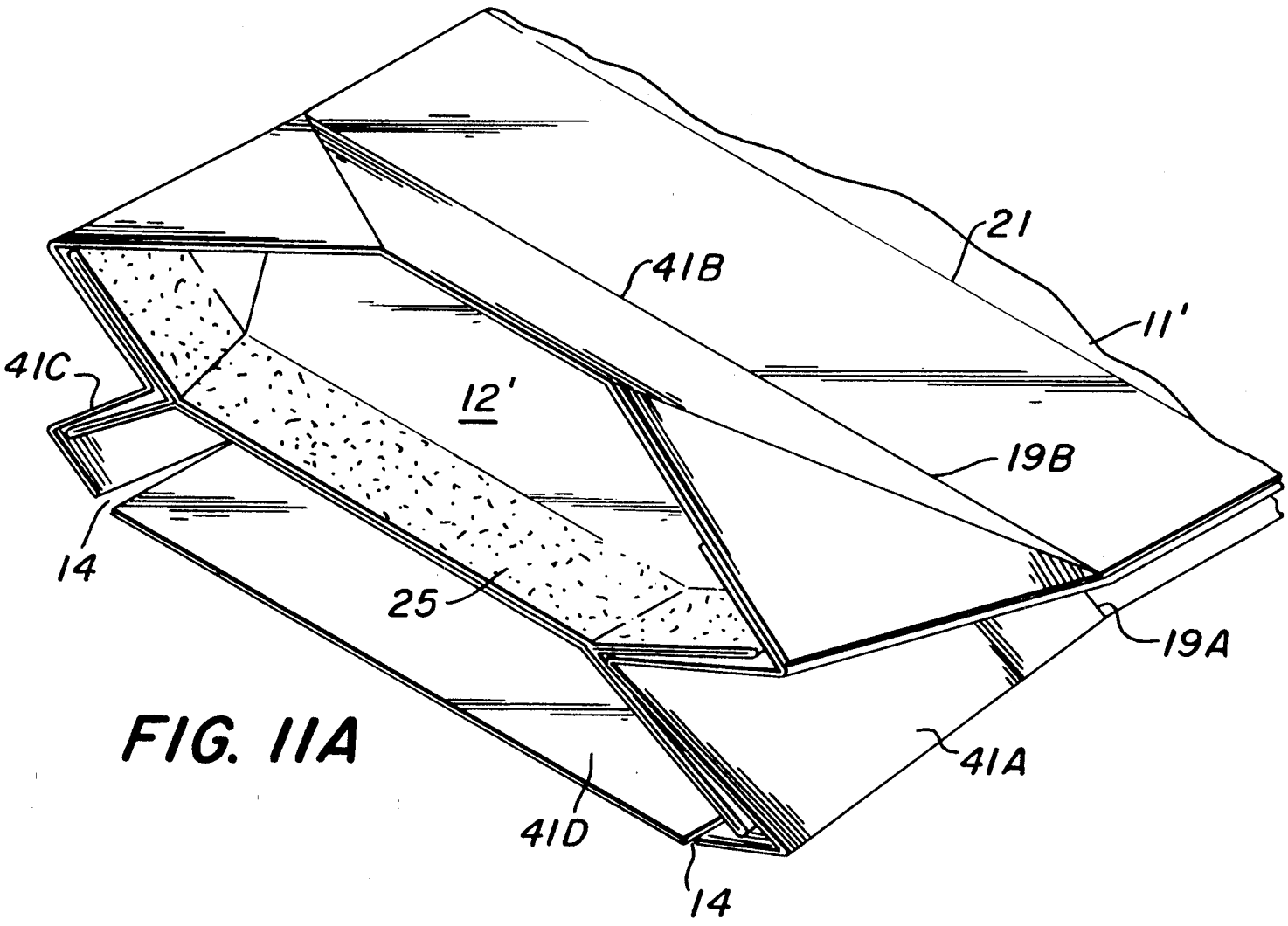
FIGS. 11A and 11B are views looking at the open bottom end of the tube during the bottom forming step.
Figure 11B:
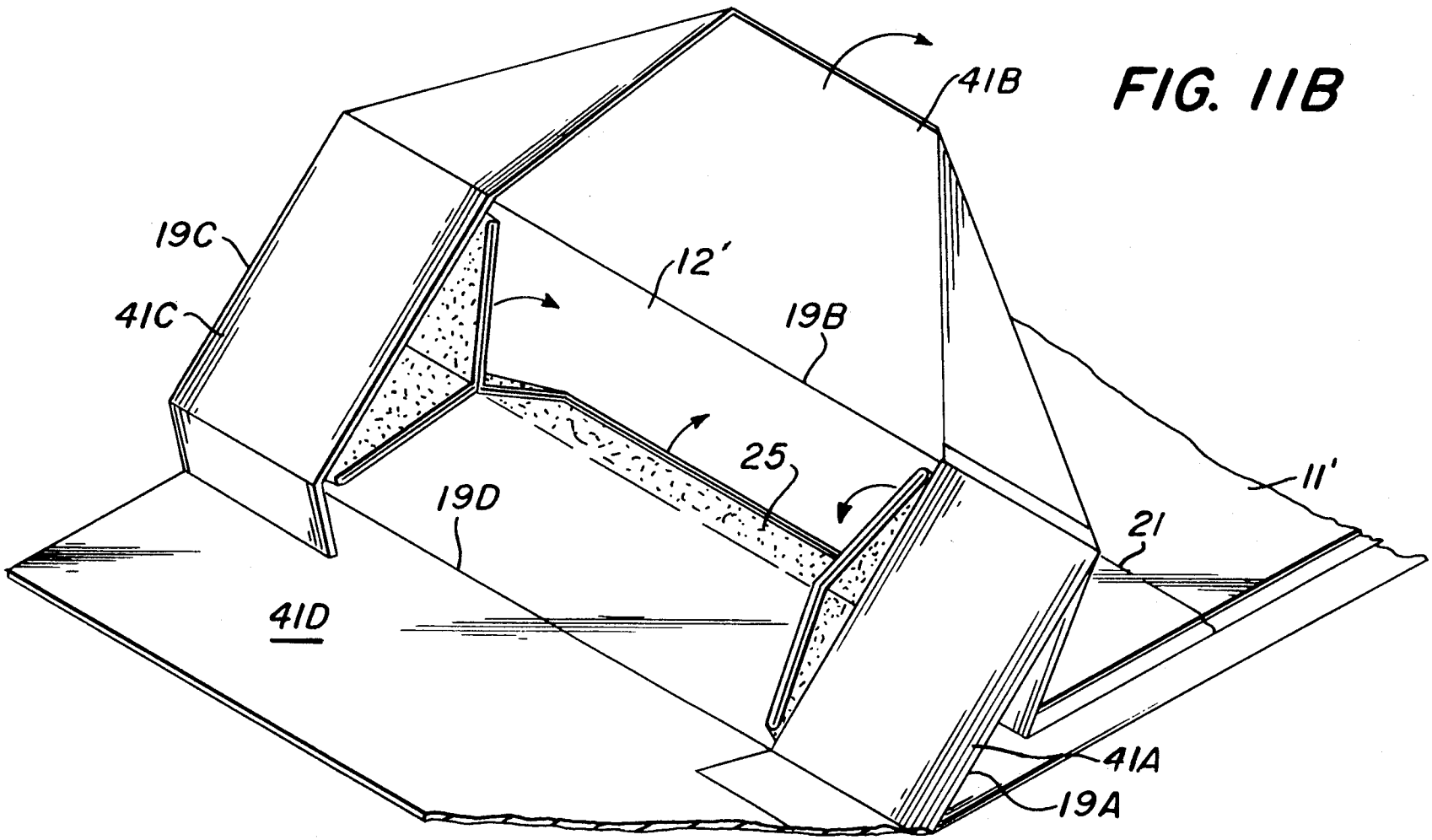

The initial stage of the bottom forming step is shown in FIG. 9 wherein the tube length is shown being fed past the score cylinder 20 to be gripped by pairs of gripping fingers 30A and 32A on the opening cylinder 30 and drum 32, respectively, and a center gripper 32B on the drum 32. More specifically, the center gripper 32B engages the leading edge of the rectangular flap portion 41D of the outer tube 11' defined between slits 14, the gripper fingers 30A and 32A grip the outer tube 11' at locations on each of the gusseted ends thereof just inwardly of the location of the fold line 19. It is noted that the bottom portion of inner tube 12' outwardly of fold line 19 is not engaged by the gripping fingers 30A, 32A or center gripper 32B. Thus, as the bottom of the tube length is fed past the opening cylinder 30 and drum 32, the bottom of the outer tube 11' is opened progressively until it reaches a fully open position wherein a rectangular configuration is formed defined by four side lines 19A–D of the fold line 19. As the opening of the outer tube 11' progresses from the position of FIG. 9 to that of FIG. 10, the bottom portion of the inner tube 12' drops back against the plane extending between the rectangular side lines 19A–D of fold lines 19 to, in effect, extend across the rectangular bottom configuration formed by this spread apart and opened bottom end of outer tube 11'. FIG. 11A shows an intermediate position of the bag structure during the opening of the bottom of the outer tube 11' and FIG. 11B shows a subsequent position when the flaps 41A and 41C extending from the side lines 19A and 19C, respectively, are folded to move inwardly. In FIG. 11B the arrows show the movement of the bottom forming portions of the outer and inner tubes 11' and 12' as these portions are being moved toward the flattened condition shown in FIG. 12. When the bottom of outer tube 11' is moved to the fully opened position, with the sealed inner tube 12' extending across the bottom end of the bag, the bag structure is in the condition to permit the safe inward tucking of the four flap portions 41A–D that form the bottom of the outer tube 11', which flap portions are folded on the four side lines 19A–D, respectively, of the fold line 19 in a manner as is conventional in the art and as is described in detail in said prior patents. As can be seen from the drawings, during the bottom forming procedure, the sealed bottom portion of the inner tube 12' collapses to extend tightly between the rectangular configuration of the fold lines 19A–D which movement happens naturally while the bottom of outer tube 11' is being opened by the opening cylinder 30 and drum 32 as it moves from the position shown in FIG. 9 to that shown in FIG. 10. It will also be noted that because of the construction and arrangement of the adhesive bar 18 which forms a closed loop band around the bottom end of the tube length, the opening of the outer tube 11' will cause the sealed inner tube 12 to move to a position extending across the bag bottom from the regions adjacent to those whereat the outer liner 11' is adhered to the inner liner 12' by adhesive bar 18.

Figure 12:
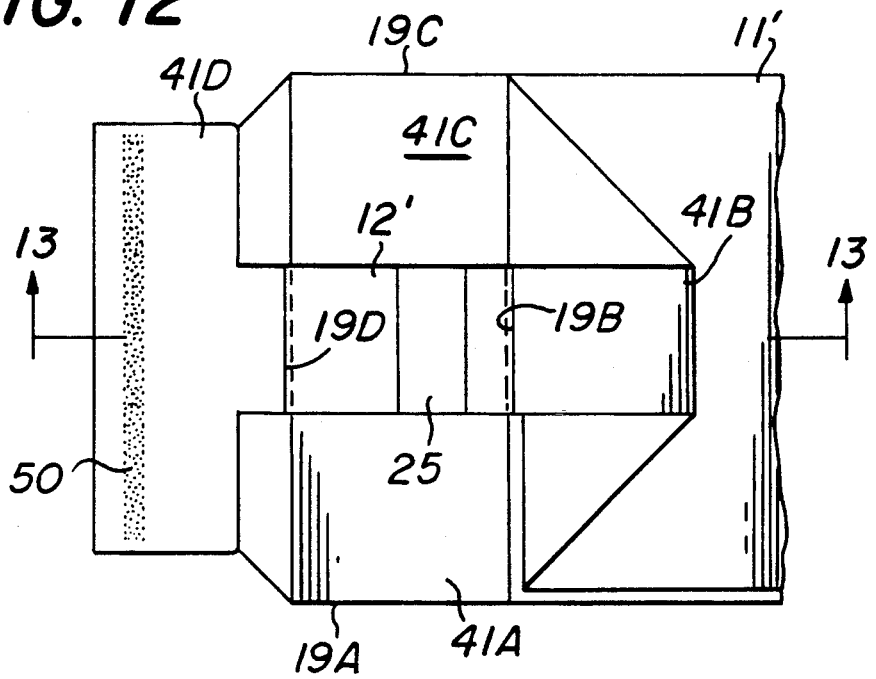
FIG. 12 is a plan view of a later step in the formation of the bottom of the bag construction in accordance with the invention.
Figure 13:
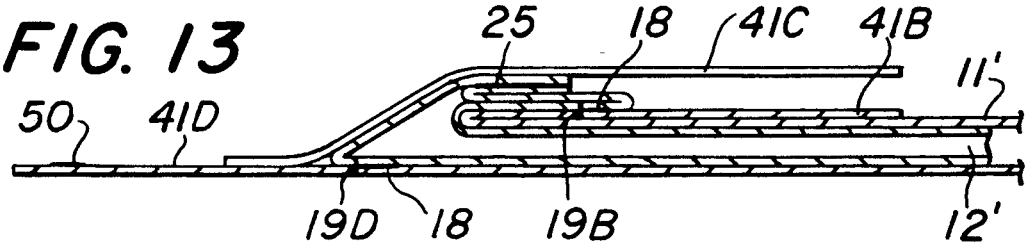
FIG. 13 is a section taken on line 13—13 of FIG. 12.
Figure 14:
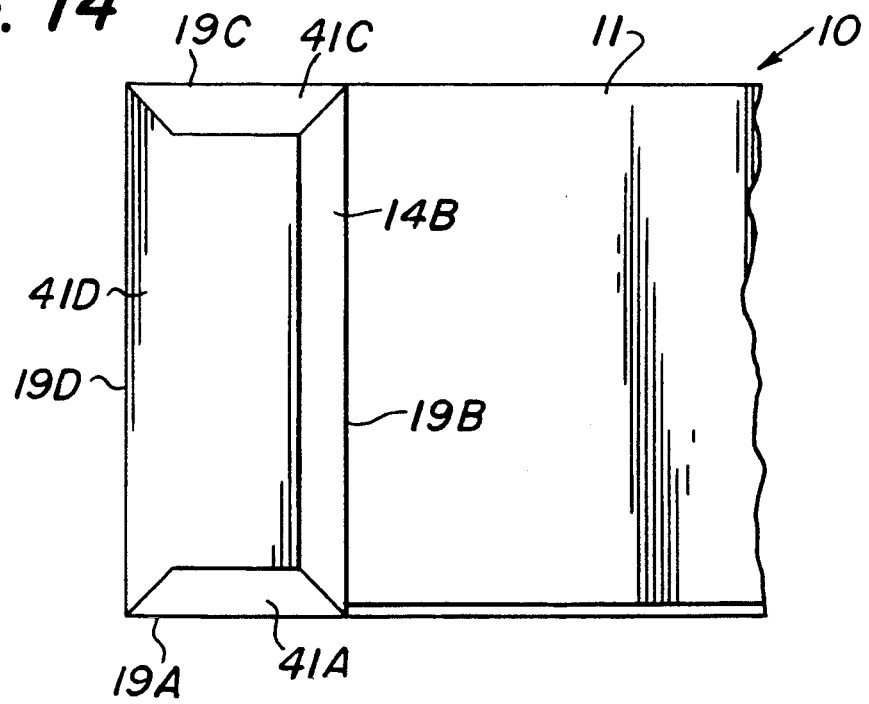
FIG. 14 is a plan view illustrating the completed bag construction in accordance with the invention.

FIGS. 12–14 illustrate the bottom closing steps as is conventional and as is described in said prior patents. As shown in these figures, and as is described in said prior patents, this procedure involves folding flaps 41A–D to a flattened condition as shown in FIG. 12 and the application of the deposits of glue or adhesive to suitable parts of the bottom flaps of the outer tube 11' after said tube has been folded to the flattened condition as shown in FIG. 12 and known as a partial diamond fold. Thus, adhesive is applied along a strip like area 50 of the tab portion 41D as shown in FIG. 12 and is described in detail in said prior patents.

In the final step of the bag closure, the triangular flap 41B of the diamond fold is folded over along fold line 19B after which the rectangular flap portion 41D is folded over along fold line 19D onto the triangular flap 41B to complete the formation of the bag bottom. Again, this is described in detail in the prior mentioned patents. During this latter step, the rectangular flap 41D is pressed into contact on top of the triangular flap 41B so that the adhesive area 50 serves to provide attachment therebetween to complete the bag bottom.

In FIG. 15, the bag 10 is shown in an open condition with the bottom being squared up. This figure also illustrates the bag construction in accordance with the invention whereby the outer bag 11 has a separate inner bag 12 contained therewithin. FIG. 15 also illustrates the construction whereby the inner bag 11 is secured to the outer bag 12 at limited regions by a construction including two adhesive bands, formed by adhesive bars 16 and 18, whereby inner bag 12 can be removed easily from outer bag 11 for disposal purposes. This separation of the bags 11 and 12 will permit the separate disposal thereof which can be important for recycling purposes since said bags 11 and 12 are made of different materials which are often recycled separately.

What is claimed is:

1. A method of making a bag construction, of the rectangular bottom type comprising an outer bag and an inner bag contained within and secured to said outer bag as a separate bag structure, comprising the steps of:

forming a tube length including an outer tube length and an inner tube length, said inner tube length being made of a heat sealable material and being sealed along a longitudinal seam thereof to provide an inner tube length structure sealed throughout its longitudinal extent but unsealed at its top and bottom ends, said inner and outer tube lengths being adhered to each other at limited contiquous areas thereof and being non-adhered throughout a substantial bottom portion thereof, said bottom portion being of a size sufficient to be formed into a rectangular bottom structure for the bag construction, providing a cross seal to said inner tube length extending transversely across the bottom end thereof to completely seal the bottom end of the inner tube length, said cross seal being formed by the application of a heat and pressure seal to the tube length, and forming a rectangular shaped bottom of the bag construction, said bottom forming step including an initial step of opening the bottom end of the outer tube length to a fully opened condition to form a rectangular configuration having four bottom flaps of the outer tube length extending from four rectangular arranged fold lines, the sealed bottom end of the inner tube length extending across the bag bottom between said fold lines, and said bottom forming step including a subsequent step of folding inwardly said four bottom flaps on said four fold lines to complete the bottom of the bag construction.

2. A method according to claim 1 wherein said seam seal of said inner tube length is formed as a heat seal.

3. A method according to claim 1 wherein said inner and outer tube lengths are adhered to each other by two bands of adhesive that extend completely around the tube length, one of said adhesive bands being located at the top end of the tube length and the other of said adhesive bands being located immediately inwardly of said four fold lines.

4. A method according to claim 1 wherein said step of providing a cross seal comprises advancing the tube length sideways and applying heat to the bottom edge thereof and then passing said bottom edge of the tube length between a pair of pressure rollers which form a pressure and heat seal across the bottom end of the inner tube length.

5. A method according to claim 1 wherein prior to the step of forming the bottom of the bag, the tube length is advanced lengthwise and has a score applied thereto to define said four fold lines, said score extending transversely across the advancing tube length.

6. A method according to claim 1 including the step of forming a pair of parallel spaced apart slits in the outer tube prior to its being formed into a tube length, said slits being formed in said outer tube wall to extend inwardly from the bottom edge thereof to define a rectangular tab portion.

7. A method according to claim 6 wherein said rectangular tab portion is part of the last flap to be folded over to complete the bottom of the bag construction and means are provided for adhesively securing said rectangular tab portion to the previously folded over flaps of said bag bottom.

8. A method according to claim 6 wherein said bottom forming step includes the step of forming the bottom end of the bag into a diamond fold with the rectangular tab portion at one end thereof and a partially triangular portion at the other end thereof, and the step of completing the bag bottom by sequentially folding over the triangular portion and then said rectangular tab portion and adhering the same together to complete the formation of the bottom of the bag.

9. A method according to claim 1 wherein said inner tube length has the same dimensions as said outer tube length.

10. A method of making a bag construction of the rectangular bottom type comprising an outer bag and an inner bag contained within and secured to said outer bag as a separate bag structure, comprising the steps of:

forming a tube length including an outer tube length and an inner tube length, said inner tube length being made of a sealable material and being sealed along a longitudinal seam thereof to provide an inner tube length structure sealed throughout its longitudinal extent but unsealed at its top and bottom ends, said inner and outer tube lengths being adhered to each other at limited contiquous areas thereof and being non-adhered throughout a substantial bottom portion thereof, said bottom portion being of a size sufficient to be formed into a rectangular bottom structure for the bag construction, providing a cross seal to said inner tube length extending transversely across the bottom end thereof to completely seal the bottom end of the inner tube length, and forming a rectangular shaped bottom of the bag construction, said bottom forming step including an initial step of opening the bottom end of the outer tube length to a fully opened condition to form a rectangular configuration having four bottom flaps of the outer tube length extending from four rectangularly arranged fold lines, the sealed bottom end of the inner tube length extending across the bag bottom between said fold lines, and said bottom forming step including a subsequent step of folding inwardly said four bottom flaps on said four fold lines to complete the bottom of the bag construction.

* * * * *